US005143234A

United States Patent [19]

Lohrman et al.

[11] Patent Number: 5,143,234

[45] Date of Patent: Sep. 1, 1992

[54] SINGLE WALLED DISPENSING CLOSURES WITH POSITIVE ALIGNMENT MEANS

[75] Inventors: Richard D. Lohrman, Grayslake, Ill.; Klaus Thanisch, Bullay, Fed. Rep. of Germany

[73] Assignee: Zeller Closures, Inc., Libertyville, Ill.

[21] Appl. No.: 744,089

[22] Filed: Aug. 12, 1991

[51] Int. Cl.[5] ..... B65D 55/02; B65D 47/08

[52] U.S. Cl. ..... 215/235; 215/216; 215/237; 215/331; 215/354

[58] Field of Search ..... 215/204, 211, 235, 237, 215/238, 243, 263, 305, 306, 330, 331, 354

[56] References Cited

U.S. PATENT DOCUMENTS

| | | | |
|---|---|---|---|
| 4,289,248 | 9/1981 | Lynn | 215/330 |
| 4,487,324 | 12/1984 | Ostrowsky | 215/253 |
| 4,533,058 | 8/1985 | Uhlig | 215/216 |
| 4,625,898 | 12/1986 | Hazard | 215/235 X |
| 4,629,081 | 12/1986 | McLaren | 215/206 |
| 4,662,530 | 5/1987 | Goncalves et al. | 215/330 |
| 4,718,567 | 1/1988 | La Vange | 215/216 |
| 4,723,669 | 2/1988 | Barriac | 215/206 |
| 4,793,502 | 12/1988 | Beck | 215/235 |
| 4,821,898 | 4/1989 | Smalley | 215/216 |
| 4,838,441 | 6/1989 | Chernack | 215/216 |

*Primary Examiner*—Stephen Marcus
*Assistant Examiner*—Vanessa Caretto
*Attorney, Agent, or Firm*—Kane, Dalsimer, Sullivan, Kurucz, Levy, Eisele and Richard

[57] ABSTRACT

This invention is directed towards improvements in snap hinge dispensing closures for molded plastic bottles. In particular, snap hinge closures of single walled construction are provided with means for positively aligning with the front of the bottle, and a relatively deeper thumb recess for facilitating lifting of a snap hinge closure lid. Means are also disclosed to prevent reverse rotation of the closure once positive alignment is achieved. Other disclosed features include a plug to prevent leakage of the bottle contents and means for preventing axial pivoting of the closure.

18 Claims, 2 Drawing Sheets

SINGLE WALLED DISPENSING CLOSURES WITH POSITIVE ALIGNMENT MEANS

FIELD OF THE INVENTION

This invention is directed towards improvements in snap hinge dispensing closures for molded plastic bottles. In particular, snap hinge closures of single walled construction are provided with means for positively aligning with the front of the bottle, and a relatively deeper thumb recess for facilitating lifting of a snap hinge closure lid.

Means are also disclosed to prevent reverse rotation of the closure once positive alignment is achieved. Other disclosed features include a plug to prevent leakage of the bottle contents and means for preventing axial pivoting of the closure.

BACKGROUND OF THE INVENTION

Plastic bottles with dispensing closures or bottle caps are the chosen packaging for a broad range of products such as shampoos, conditioners, hand lotions, household detergents, cleaning products and contact lens solutions, to list a few of a vast menagerie of products. They abound and pervade our everyday existence.

Normally, the dispensing closures are mounted on the neck of the bottles by inter-engaging screw threads or a snap on arrangement characterized by a frictional fit.

Dispensing closures are generally of single wall or double wall construction. Single wall closures have one side wall of a generally cylindrical shape. Double wall closures are characterized by a double sidewall arrange ment having interior and exterior sidewall of generally cylindrical shape. If threaded engagement means are utilized in a double side wall closure, the threads are located upon the interior side of the interior cylindrical sidewall (see FIG. 7, depicting this prior art closure).

The choice of closure, whether it be double or single wall construction, directly affects the design and manufacturing parameters of the mating plastic bottles. Double wall closures necessarily have bottle necks of reduced size, requiring a high blow ratio in bottle manufacture. This means that if a double wall closure is chosen, the volume of the bottle itself is limited. On the other hand, single walled closures can be designed with larger necks and are thus moldable into larger sizes and shapes.

In addition to practical design considerations, as for example, bottle size, other less obvious factors are of significance. Those who manufacture plastic bottles, and those who package product in plastic bottles have justifiable concerns regarding the aesthetics of the packaging. It is important that product packaging be pleasing to the consumer as this is the source of initial introduction of the product to the consumer. Thus, the container designer should consider and employ available means of visually enhancing the package.

One such means is disclosed in U.S. Pat. No. 4,877,144 which is incorporated herein by reference. This patent discloses a bottle closure having a segmented external thread that is molded so as to eliminate the occurrence of mold markings on the exterior wall of the threaded sleeve.

With respect to snap hinge closures having a thumb recess for facilitating the lifting of the lid, another consideration is to position the thumb recess so that it is centered upon the wider side of a bottle having an oval or elliptical cross section. This is referred to as positive alignment. Besides the aesthetic enhancement provided by the symmetry, the consumer benefits from a more convenient access to the recess. This has been achieved for double walled closures, but no such positive alignment means are known for single walled closures. This represents a substantial deficiency in the technology, since single walled closures permit the bottle to be of larger size.

SUMMARY OF THE INVENTION

It is an object of the invention to provide single walled snap hinge dispensing closures with positive alignment means for orienting the closure in a predetermined manner on the neck of a bottle.

It is another object of the invention to provide a closure of the foregoing type not requiring a liner that is able to withstand leakage independent of application torque.

It is still another object of the invention to provide a closure of the foregoing type having a deeper thumb recess for lifting a hinged closure lid.

It is a further object of the invention to provide a closure of the foregoing type with means for prohibiting the axial pivoting of the closure upon the bottle neck.

It is still a further object of the invention to provide a closure of the foregoing type with means for locking the positively aligned closure in place.

It is an important object to provide a closure of the foregoing type that is of lighter weight and capable of being molded with a simple mold construction.

The foregoing objects are attained by a snap hinge dispensing closure of single wall construction having means for providing a positive alignment of the thumb recess for facilitating the lifting of a hinged closure lid. In the preferred embodiment, cooperating mating alignment ribs are located upon the bottle neck and of the interior of the closure. They are positioned and interrelated in such a manner that when the closure is threaded upon the bottle neck, the mating ribs do not contact one other in the first instance but eventually contact and abut each other after at least one full turn of the closure upon the bottle neck and before one and one-half full turns of the closure upon the bottle neck, thereby positioning the thumb recess in the center of the bottle face. The abutment of the mating ribs provides an interference and, consequently, a stop to further threading of the closure upon the bottle neck. This stop assures the location of the the recess in the center of the bottle face.

The benefit of such centering of the thumb recess is readily apparent when utilizing a bottle of an elliptical, oval, or any non-circular cross section. However, this positive alignment as also applies to bottles of circular cross section as well thereby providing the package designer with means for aligning the thumb recess with the trademark or other labeling of the package.

The invention is also directed to a linerless dispensing closure able to withstand leakage independent of the application of torque. In this regard, the closure possesses a sealing plug which fits between the inside diameter of the sidewall of the closure and the outside diameter of the bottle neck.

The dispensing closure of the present invention also provides for a deeper thumb recess permitting easier opening of a hinged lid by the consumer. This is facilitated by permitting use of a bottle neck finish that are smaller at the thumb recess, thereby permitting the molding of a closure with a deeper thumb recess. This is an improvement over conventional single wall closures which are limited as to the depth of the thumb recess by the thickness of the sidewall of the closure.

In addition, the dispensing closure of the present invention incorporates locking means for maintaining the closure in positive alignment as well as a vertical alignment means which minimizes if not prohibits vertical pivoting of the closure about its vertical axis.

DETAILED DESCRIPTION OF THE PREFERRED EMBODIMENT

Figure 1:
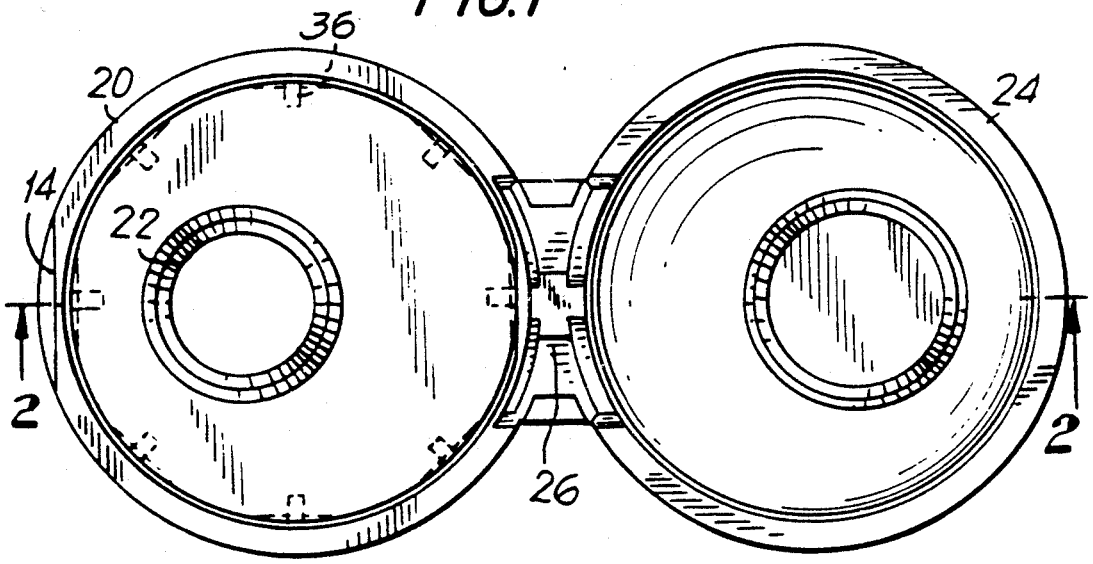
FIG. 1 is a top plan view of the snap hinge closure of the present invention.
Figure 2:
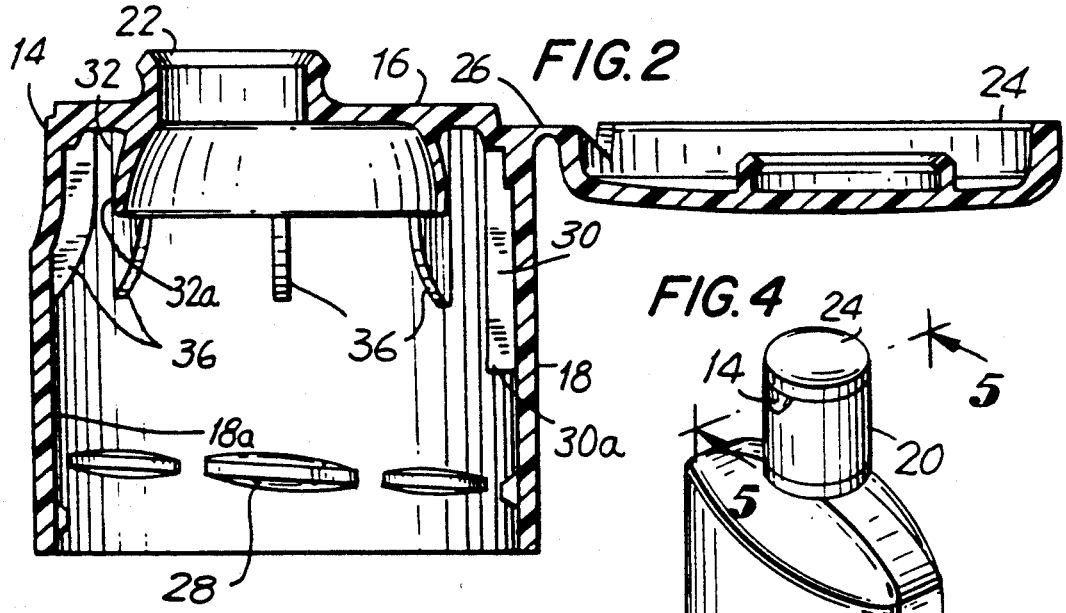
FIG. 2 is a longitudinal sectional view taken along the line 2—2 of FIG. 1. 1

The dispensing closure 20 includes a top 16, skirt 18, spout 22, cap or lid 24, thumb recess 14, and snap hinge means 26. The thread means 28 shown in the drawings are interrupted, and may be of the type disclosed in U.S. Pat. No. 4,877,144 and may also be molded in a manner disclosed therein. The closure may also be molded with conventional uninterrupted threads, and any of the molding means employed in the art can be employed for such purposes. Furthermore, the snap hinge may be of the type disclosed in U.S. Pat. No. 4,403,702.

The closure further consists of an alignment rib 30 extending radially inwardly from the inner face of the skirt 18. The lowermost part 30*a* of rib 30 terminates adjacent to or slightly above the horizontal plane formed by upper end of the thread means 28 characterized by the circumferential helix.

The closure also has a closure plug 32 depending downwardly from the inner face of the top 16 and extending circumferentially on and located interior of the skirt 18. The plug 32 advantageously forms a seal with the interior wall of the bottle neck. In this regard, the closure plug 32 is dimensioned to extend for a length in the axial plane of the closure so as to fit within the aforedescribed space in order to create a barrier that will prevent leakage of the contents of the bottle when the closure is threaded upon the bottle neck.

The closure is additionally provided with radially inwardly extending jump threads 36 spaced circumferentially about the interior of the skirt 18. The radially extending jump threads are dimensioned so that when the closure is threaded upon the bottle neck there is a clearance between the jump threads 36 and the bottle neck 18. A relatively deeper thumb recess 14 upon the exterior of the skirt 18 can be provided by taking advantage of the space provided by this clearance, thereby facilitating easy opening of the closure.

The bottle 40 that receives closure 20 is formed with a body 42 and bottle neck 44. A thread 46 upon the exterior wall of bottle neck is designed and intended to engage with the thread means 28 upon the closure 20 to fixedly engage the closure 20 and e the bottle neck 44. The bottle neck alignment rib 48 is positioned upon the top of the thread at a point substantially near its terminus 46*a*. The bottle neck alignment rib 48 extends radially outwardly from the bottle neck.

Figure 4:
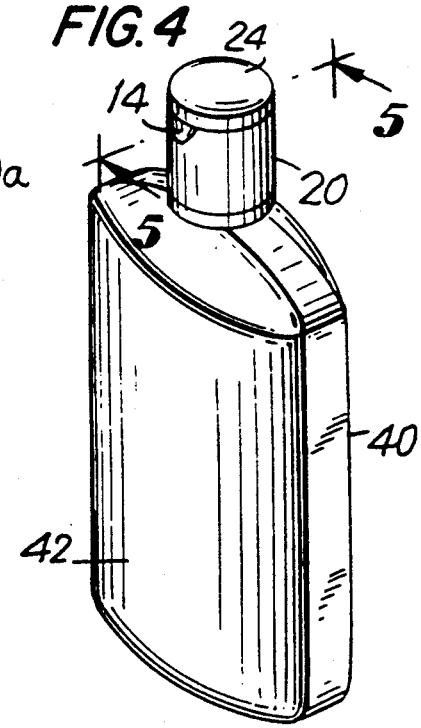
FIG. 4 is a perspective view of a bottle with the snap hinge closure.
Figure 5:
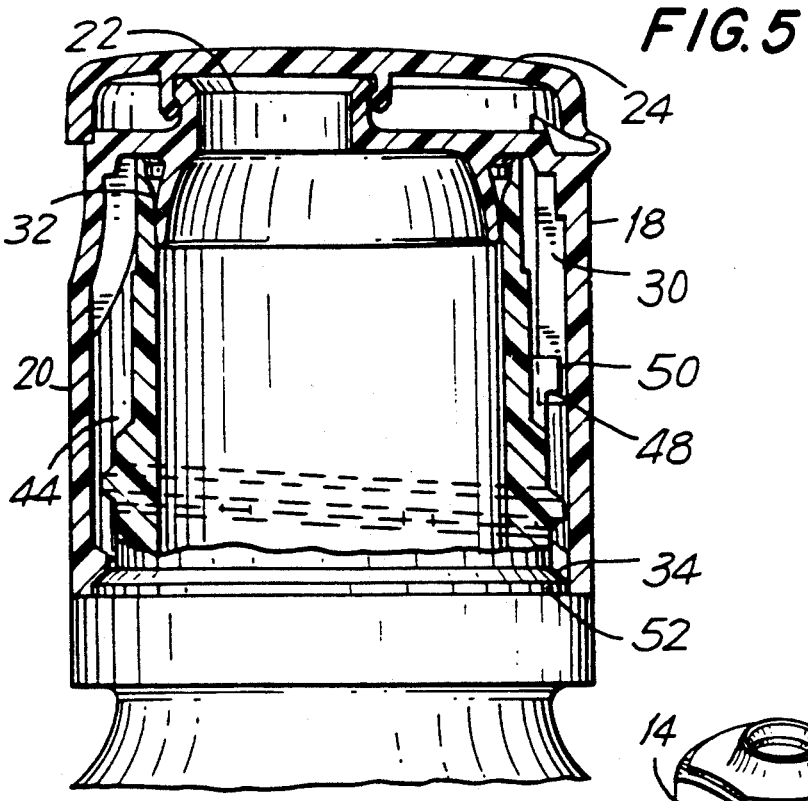
FIG. 5 is a longitudinal sectional view taken along line 5—5 of FIG. 4 showing the closure and bottle neck in fixed engagement.
Figure 6:
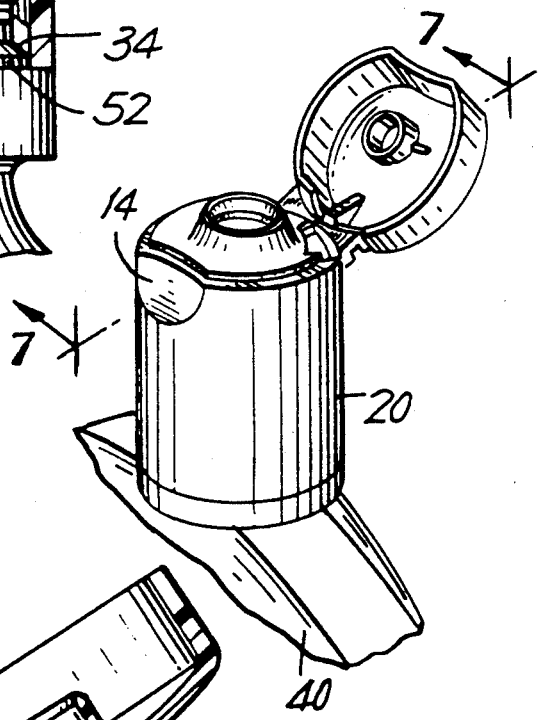
FIG. 6 is an enlarged fragmentation perspective view of an open closure on the bottle.
Figure 7:
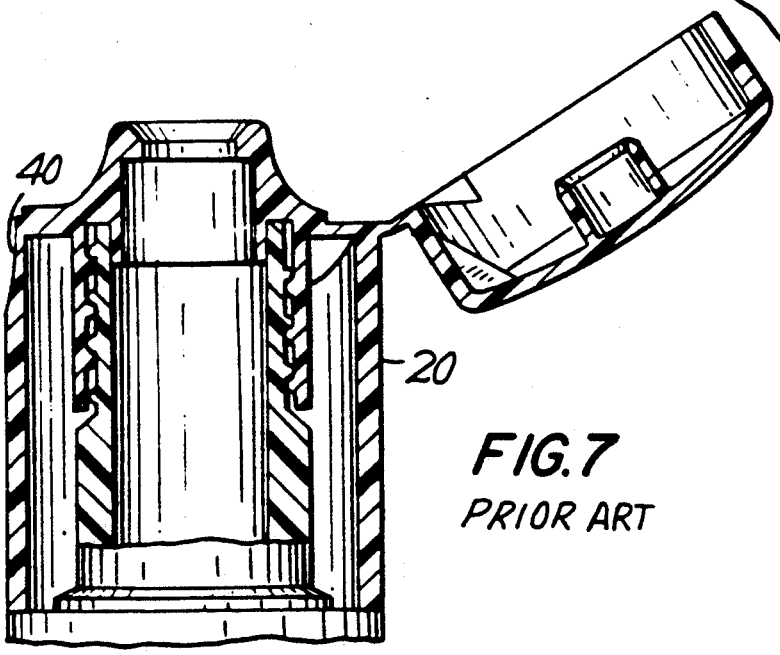
FIG. 7 PRIOR ART
FIG. 7 depicts the prior art closure on a bottle neck.

Referring to FIG. 5, positive alignment of the thumb recess results when the closure 20 is threaded upon the bottle neck 44 and abutment results between the closure alignment rib 30 and the bottle neck alignment rib 48. During the threading action the closure alignment rib 30 will on the first pass miss the bottle neck alignment rib 48. However, after one to one and one-half application turns of the closure 20, the closure alignment rib 30 contacts and abuts the bottle neck alignment rib 48 thereby creating interference to further rotation of the closure. Abutment of the ribs is shown in FIG. 5. At this point, the thumb recess is positively aligned in the center of the front face of the bottle. Positive alignment is also depicted in FIG. 4. Furthermore, the screwing action will have caused the closure plug 32 to enter the interior of and engage with the bottle neck 44, providing a seal against leakage.

Molding of the closure 20 may lie in accordance with the method disclosed in the '144 patent which is advantageous because of the simplicity of the method and the simplicity of the mold construction.

The present invention additionally includes vertical alignment means 52 in the form of a shoulder located at the bottom of the bottle neck finish. The vertical alignment mean 50 extends circumferentially about the exterior of the bottle neck. The alignment means 52 creates a slight clearance with the lower interior edge of the skirt 18 after riding over cam face 34. This stabilizes the bottom of the closure and minimizes the cocking of the closure. The lower edge of the skirt 18 and the vertical alignment means 52 will thus abut each other when the closure 20 is threaded upon the bottle neck 44. The abutment prohibits pivotal movement and assures a coaxial positioning when fully threaded upon the neck 44.

Figure 3:
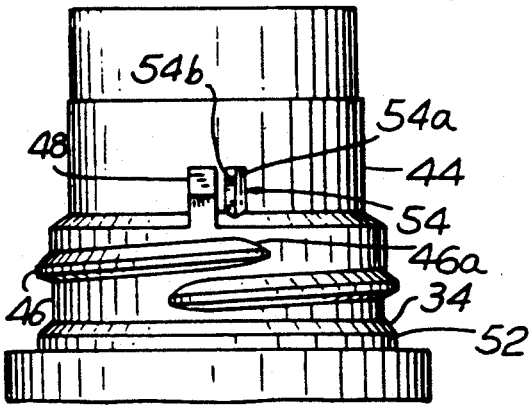
FIG. 3 is an elevational sectional view of the bottle neck finish.

The bottle neck of the invention also is provided with a locking means to lock the closure into place at the point of positive alignment. The locking means is shown in FIG. 3 as a tapered rib 54 having a tapered side 54*a* and a flat side 54*b*. Tapered side 54*a* of the tapered rib 54 faces in the direction which is counter to the direction of thread movement. In other words, if the closure is threaded on to the bottle neck in a clockwise direction then the tapered side faces the counterclockwise direction. The rib 54 is further positioned proximate to the bottle neck alignment rib 48 on the side counter to the direction of thread movement, and is spaced apart by a distance that substantially corresponds to the width of the closure alignment rib 30. When the closure 20 is threaded onto the bottle neck 44, the closure alignment rib 30 will contact the tapered side at a point prior to positive alignment. After riding on the tapered side 54*b*, the closure rib 30 snaps into position between the tapered rib 54 and the bottle neck alignment rib 48. The flat side of tapered rib 54*b* will now abut the closure alignment rib 30, thereby preventing reverse rotation of the closure.

I claim:

1. A single wall snap hinge closure for a bottle, the bottle having a front face, a threaded neck and an alignment means positioned thereon, the closure having a circumference and an axis and being comprised of:

a) a skirt having an interior and an exterior and a thumb recess upon the exterior;

b) a top having an opening to permit dispensing of contents of the bottle;

c) means for sealing the opening on the top;

d) screw thread means for mating with the threads on the neck of the bottle, said thread means being formed on a helical path on the interior surface of the skirt; and e) an alignment mans positioned on the interior surface of the skirt, the alignment means being dimensioned to fit within a space between the interior surface of the skirt and an exterior of the bottle neck; said alignment means of the closure being adapted to abut the alignment means positioned upon the bottle neck during threading of the closure upon the bottle neck, such abutment resulting in an interference to further threading of the closure upon the bottle and resulting in positive alignment of the thumb recess with the front face of the bottle.

2. The closure of claim 1 wherein the means for sealing the opening on the top is a pivotal lid for coupling with the opening and pivotal between an open position and a closed position.

3. The closure as set forth in claim 1 further comprised of a closure plug integral with the top of the closure and located to be in engagement with an interior wall of the bottle neck, said closure plug depending downwardly from the top so that when the closure is threaded upon the bottle neck the closure plug will engage with the interior wall of the bottle neck to form a seal and prevent leakage of the contents of the bottle.

4. The closure as set forth in claim 1 further being comprised of at least one radially inwardly extending jump thread integral with the interior of the skirt and extending for a length parallel to the axis of the skirt, the at least one radially extending jump thread being dimensioned so there is a clearance between said jump thread and the neck of the bottle, thereby facilitating a formation of a relatively deeper thumb recess.

5. A bottle having means for positively aligning a thumb recess of a dispensing closure having an interior having helical screw threads and an alignment means associated therewith, the bottle comprises of:

a) a body;

b) a bottle neck extending from the body and having an exterior surface;

c) screw thread means positioned upon the exterior surface of the bottle neck and being formed in a helical path having an uppermost portion, said thread means adapted to mate with helical screw threads formed on the interior of the closure; and d) an alignment means extending radially on the exterior of the bottle neck above the uppermost portion of the helical path, said alignment means of the neck being adapted to fit between the interior of the closure and the exterior wall of the bottle neck; said bottle neck alignment rib being of sufficient dimension so as to abut the alignment means positioned upon the closure during threading of the closure upon the bottle neck, such abutment resulting in an interference to further threading of the closure upon the bottle and resulting in positive alignment of the thumb recess.

6. The bottle as set forth in claim 5, further comprised of means for preventing reverse rotation of the closure once the closure is positively aligned.

7. The bottle as set forth in claim 6, wherein said means for preventing reverse rotation is comprised of a locking rib, said rib extending radially outwardly from the exterior of the bottle neck, said rib having a tapered side and a flat side next tot he tapered side, the tapered side facing in a direction counter to a direction of thread movement as the closure is threaded upon the bottle, the flat side having depth substantially corresponding to a depth of the alignment means on the closure, said locking rib being positioned to a side of the alignment means of the bottle that is in a direction counter to a direction of thread movement as the closure is threaded upon the bottle and being spaced from the alignment means upon the bottle for a distance substantially corresponding to a width of the alignment means upon the closure, so that when the closure is threaded upon the bottle neck and approaches a point of positive alignment the closure alignment means rides along the tapered side and then snaps into position between the locking rib and bottle neck alignment means.

8. The bottle as set forth in claim 7 further comprised of means for aligning the closure to restrict axial pivoting of the closure.

9. The bottle as set forth in claim 8 wherein the bottle neck has a base and a diameter, the closure has a bottom, the means for restricting axial pivoting is comprised of a shoulder, said shoulder extending circumferentially around the base, the shoulder having an outer diameter that is slightly greater than the diameter of the bottle neck, so that when the closure is threaded upon the bottle neck the shoulder stabilizes the bottom of the closure to minimize cocking of the closure, thereby creating an interference to axial pivoting of the closure.

10. The combination of a single wall snap hinge dispensing closure and a container bottle for providing a positive alignment of a thumb recess on the closure with a front side of the bottle comprises of:

a) a closure comprising:

i) a skirt having an interior and an exterior and a thumb recess upon the exterior;

ii) a top having an opening to permit dispensing of a contents of a bottle;

iii) means for sealing the opening on the top;

iv) screw thread means being formed on a helical path on the interior surface of the skirt; and v) an alignment means extending radially inwardly from the interior wall of the skirt, the alignment means being dimensioned to fit within a space between an interior side of the skirt and an exterior side of the bottle neck; and b) a bottle consisting of a container body having a front side and a bottle neck, the bottle neck comprising:

i) screw thread means positioned upon the exterior of the bottle neck formed in a helical path upon the exterior of the bottle neck, the helical path having an uppermost part; and ii) an alignment means positioned upon the exterior side of the bottle neck and positioned above the uppermost part of the helical path, said alignment means being dimensioned so as to fit between the interior of the skirt and the exterior side of the bottle neck;

wherein the respective thread means formed upon the closure and the threads means formed upon the bottle neck correspond and mate permitting the closure to be threaded upon the bottle neck;

and wherein the respective alignment means positioned upon the closure and bottle necks are each of sufficient dimension so as to abut each other during threading of the closure fully upon the bottle neck resulting in positive alignment of the thumb recess with the front side of the bottle and resulting in an interference thereby forming a stop to further threading of the closure upon the bottle neck.

11. The combination as set forth in claim 10 wherein the means for sealing the opening on the top is comprised of a pivotal lid for coupling with the opening and pivotal between an open position and a closed position.

12. The combination as set forth in claim 10, further comprised of means for preventing reverse rotation of the closure once the closure is positively aligned.

13. The combination as set forth in claim 12, wherein said means for preventing reverse rotation is comprised of a locking rib, said rib extending radially outwardly from an exterior side of the bottle neck, said rib having a tapered side and a flat side next to the tapered side, the tapered side facing in a direction counter to a direction of thread movement as the closure is threaded upon the bottle, the flat side having a depth substantially corresponding to a depth of the alignment means on the closure, said locking rib being positioned to a side of the alignment means or the bottle that is in the direction counter to the direction of thread movement as the closure is threaded upon the bottle and being spaced apart from the bottle neck alignment means for a distance substantially corresponding to a width dimension of the alignment means upon the closure, so that when the alignment means of the closure approaches positive alignment during threading of the closure the closure alignment means rides along the tapered side and then snaps into position between the locking rib and the bottle neck alignment means.

14. The combination as set forth in claim 10 further comprised of a closure plug integral with the top of the closure and being engaged upon an interior wall of the bottle neck, said closure plug extending circumferentially and depending downwardly from the top, so that when the closure is threaded upon the bottle neck the closure plug engages with the interior wall of the bottle neck to form a seal therewith and prevents leakage of contents of the bottle.

15. The combination as set forth in claim 10 further comprised of means for aligning the closure to restrict axial pivoting of the closure.

16. The combination as set forth in claim 15 wherein the bottle neck has a base, the closure has a bottom, the means for restricting axial pivoting comprises a shoulder, said shoulder extending circumferentially around the base, the shoulder being dimensioned so that when the closure is threaded upon the bottle neck the shoulder stabilizes the bottom of the closure to minimize cocking of the closure, thereby creating an interference to axial pivoting of the closure.

17. The closure as set forth in claim 10 further being comprised of at least one radially inwardly extending jump thread integral with the interior of the skirt and extending for a length parallel to an axis of the skirt, the at least one radially extending jump thread being dimensioned so there is a clearance between said jump thread and the neck of the bottle, thereby facilitating formation of a relatively deeper thumb recess.

18. A single wall snap hinge closure for a bottle, the bottle having a front face, and a threaded neck, the closure having a circumference and an axis and being comprised of:

a) a skirt having an interior and an exterior and a thumb recess upon the exterior;

b) a top having an opening to permit dispensing of contents of the bottle;

c) means for sealing the opening on the top; and d) at least one radially inwardly extending jump thread integral with the interior of the skirt and extending for a length parallel to the axis of the skirt, the at least one radially inwardly extending jump thread being dimensioned so there is a clearance between said jump thread and the neck of the bottle, thereby facilitating a formation of a relatively deeper thumb recess.

* * * * *